US007559335B2

(12) United States Patent
Smith

(10) Patent No.: US 7,559,335 B2
(45) Date of Patent: Jul. 14, 2009

(54) SELF-ERECTING STRUCTURE

(75) Inventor: George G. Smith, Knoxville, TN (US)

(73) Assignee: Gilliam Licensing Group LLC, Winston-Salem, NC (US)

( * ) Notice: Subject to any disclaimer, the term of this patent is extended or adjusted under 35 U.S.C. 154(b) by 0 days.

(21) Appl. No.: 11/740,043

(22) Filed: Apr. 25, 2007

(65) Prior Publication Data

US 2007/0251564 A1 Nov. 1, 2007

Related U.S. Application Data

(60) Provisional application No. 60/794,778, filed on Apr. 25, 2006.

(51) Int. Cl.
*E04H 15/42* (2006.01)

(52) U.S. Cl. ..... 135/156; 135/127; 135/136; 135/905

(58) Field of Classification Search ..... 135/124–128, 135/156, 114, 119, 905, 136–137, 95
See application file for complete search history.

(56) References Cited

U.S. PATENT DOCUMENTS

| | | | | | |
|---|---|---|---|---|---|
| 2,963,030 | A * | 12/1960 | Blanchard | 135/123 |
| 3,223,098 | A * | 12/1965 | Dole, Jr. | 135/126 |
| 3,834,410 | A * | 9/1974 | Leibel | 135/123 |
| 4,706,696 | A * | 11/1987 | Gillis | 135/127 |
| 4,716,918 | A * | 1/1988 | Hayashida et al. | 135/93 |
| 4,827,958 | A * | 5/1989 | Cantwell et al. | 135/127 |
| 4,979,531 | A * | 12/1990 | Toor et al. | 135/127 |
| 5,197,504 | A * | 3/1993 | Howe | 135/127 |
| 6,042,297 | A * | 3/2000 | Lah | 403/348 |
| 6,286,531 | B1 * | 9/2001 | Joo-Tai | 135/114 |
| 6,351,851 | B1 * | 3/2002 | Yardan | 2/89 |
| 6,450,187 | B1 * | 9/2002 | Lin et al. | 135/114 |
| 6,672,323 | B2 * | 1/2004 | Gupta et al. | 135/126 |
| 6,843,261 | B2 * | 1/2005 | Gillis | 135/156 |
| 7,174,584 | B2 * | 2/2007 | Danaher | 5/414 |
| 2003/0089390 | A1 * | 5/2003 | Seo | 135/127 |

FOREIGN PATENT DOCUMENTS

GB 2148967 A * 6/1985

* cited by examiner

*Primary Examiner*—Winnie Yip
(74) *Attorney, Agent, or Firm*—Kilpatrick Stockton LLP

(57) ABSTRACT

Embodiments of the present invention provide structures. For example, in one embodiment comprises a single support pole and a fabric covering. The single support pole comprises first and second hollow end members, each hollow end member comprising a first end having a fitting configured to engage with a fastener, and a second end configured to engage with an interior member, a plurality of hollow interior members each having two ends, and an elastic member having first and second ends, wherein the elastic member extends through the interior of each of the plurality of hollow interior members. The fabric covering comprises at least two fasteners, wherein the fabric covering is configured to be coupled to the support pole such that the fabric shell forms at least one wall and a roof for the structure, and wherein the fabric shell is configured to be coupled to the ground.

8 Claims, 11 Drawing Sheets

SELF-ERECTING STRUCTURE

CROSS-REFERENCES TO RELATED APPLICATION

This application claims priority to U.S. Provisional Patent Application No. 60/794,778, filed Apr. 25, 2006, entitled "Self-Erecting Structure," the entirety of which is hereby incorporated herein by reference.

FIELD OF THE INVENTION

The present invention relates generally to structures. Embodiments of the present invention include self-erecting structures. Embodiments of the present invention include structures suitable for use as cover in an outdoor environment.

BACKGROUND

Portable structures are quite widespread in use, both on a recreational level and for use in practical applications such as the military. Due to the nature in which portable structures may be used, a portable structure must be lightweight, strong, and yet able to withstand the forces of nature once it is erected. One problem with conventional portables structures is that such portable structures must be assembled from a large number of individual components, including structural components as well as the fabric covering of the portable structure. Because of the nature of this interdependence, the erection of most portable structures is a time-consuming and tedious task, which can be difficult to accomplish in inclement weather conditions, or in reduced lighting.

SUMMARY

Embodiments of the present invention provide structures. For example, in one embodiment of the present invention, a portable structure comprises a single support pole and a fabric covering. The single support pole comprises first and second hollow end members, each hollow end member comprising a first end having a fitting configured to engage with a fastener, and a second end configured to engage with an interior member, a plurality of hollow interior members each having two ends, wherein each end is configured to engage with the end of another hollow interior member or the second end of a hollow end member, and an elastic member having first and second ends, the first end of the elastic member is coupled to the interior of the first end of the first hollow end member, the second end of the elastic member is coupled to the first end of the second hollow end member, and wherein the elastic member extends through the interior of each of the plurality of hollow interior members. The fabric covering comprises at least two fasteners, wherein the fabric covering is configured to be coupled to the support pole such that the fabric shell forms at least one wall and a roof for the structure, and wherein the fabric shell is configured to be coupled to the ground.

This illustrative embodiment is mentioned not to limit or define the invention, but to provide an example to aid understanding thereof. Illustrative embodiments are discussed in the Detailed Description, and further description of the invention is provided there. Advantages offered by various embodiments of this invention may be further understood by examining this specification.

BRIEF DESCRIPTION OF THE DRAWINGS

These and other features, aspects, and advantages of the present invention may be better understood when the following Detailed Description is read with reference to the accompanying drawings.

DETAILED DESCRIPTION

Figure 1:
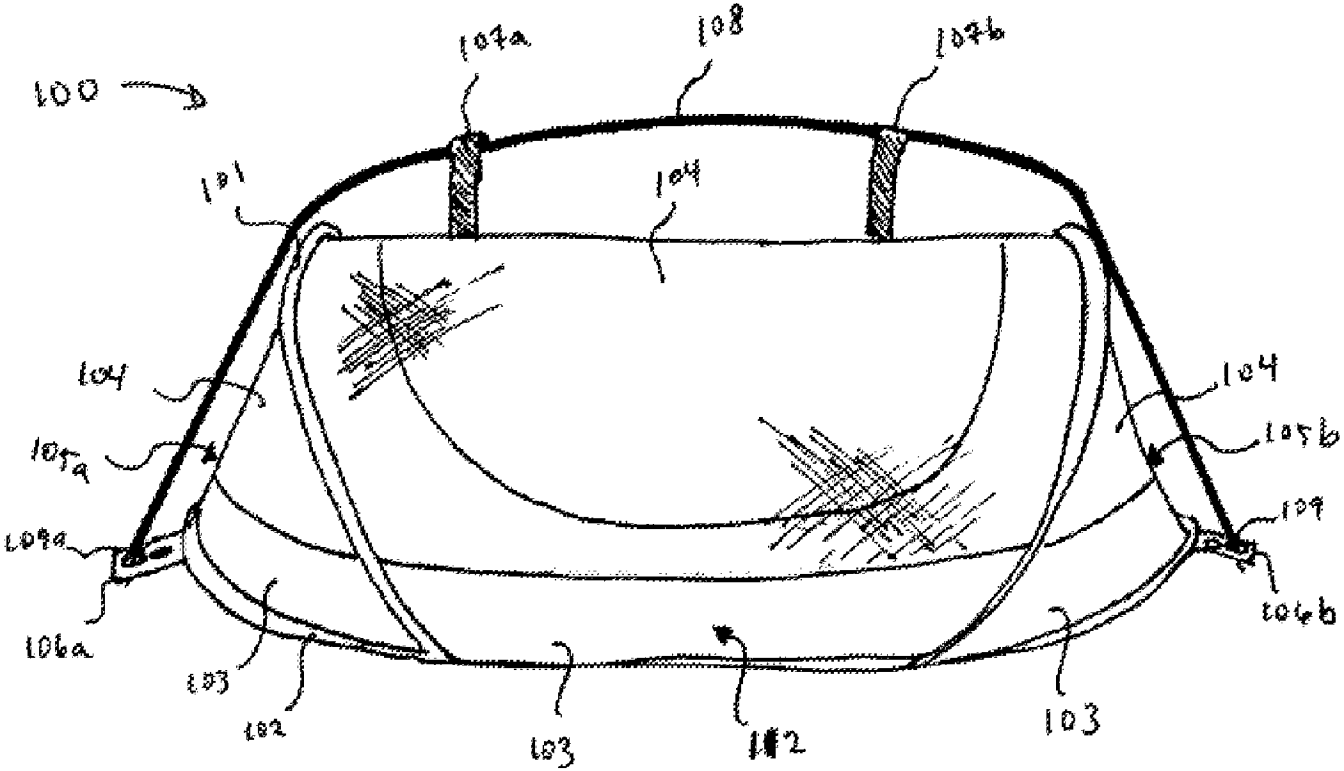
FIG. 1 is a diagrammatic view of a structure in one embodiment of the present invention.

Embodiments of the present invention provide structures, such as portable structures suitable for use by one or more people.

In one illustrative embodiment of the present invention, a structure may be provided by a self-erecting structure. For example, a self-erecting structure may comprise a flexible substantially-circular member forming upper and lower loops configured to provide a frame for the structure. The structure may further comprise a fabric shell configured to contain and be supported by the flexible member. The structure may be configured to be folded into a small form factor to be easily carried. The structure may further be configured to spring into an erected configuration when removed from a pouch.

The fabric shell may comprise a substantially impermeable floor portion configured to provide a barrier against the environment, and an upper portion having a screen portion configured to allow air to flow into and out of the structure. The fabric shell may further comprise a zipper or other fastener or fasteners to provide an opening into the structure such that an individual may enter or exit the structure, and close the opening using the fasteners.

The illustrative structure may further comprise a single fly-pole and a rain fly. A fly-pole may comprise two hollow end members, and a plurality of shorter hollow members 120 configured to engage with other members to form a unitary support pole. Each of the members of the fly pole may have an elastic member 121 running through the hollow member, with each end of the elastic member attached to one of the two end members. The elasticity of the member may provide a force to hold the members in a unitary support-pole configuration. The fly pole may further comprise a shape complementary to the contour of the structure. For example, the fly pole may define two end portions that slope from the ground and approximately follow the angle of the head and foot of the erected structure. The fly pole may further define a center portion configured to provide support to the roof of the structure. Angled portions of the fly-pole may provide a coupling between the end portions and the center portion of the fly-pole. When assembled, the fly-pole may engage with grommets or fasteners coupled to the head and foot of the structure, and may engage with clips coupled to the structure such that the fly pole provides additional, external support for the structure.

The fly-pole (also referred to through the specification as a support pole), in this illustrative embodiment, may further be suited to support a rain fly. A rain fly, according to this illustrative embodiment of the present invention, may comprise a sheet of water-resistant fabric, or a poncho, or fabric treated with a substance to impart water-resistant qualities to the fabric. The rain fly may be positioned over the fly-pole and the structure, and may be supported by, and coupled to, the fly-pole. Thus, the fly-pole and rain fly may provide protection from environmental conditions to an inhabitant of the structure. For example, the fly-pole and rain fly may provide protection from rain or snow.

Referring now to the figures in which like numerals refer to like parts throughout the several drawings, FIG. 1 shows a side view of one potential embodiment of the present invention. The structure 100 shown in FIG. 1 comprises a flexible, substantially-circular member forming upper and lower loops 101 and 102 that abut along part of their circumference. The structure 100 further comprises a shell 112 comprising an upper portion 104 and a lower portion 103. In the embodiment shown, member forming loops 101 and 102 may be received in sleeves (not visible) such that the member may be bent and, by flexing against the sleeves, the member thereby may put the shell under tension to form loops 101 and 102 and provide at least part of the structural support for the structure 100. The flexible member that forms loops 101 and 102 may be constructed of any semi-rigid, flexible material such that the member will attempt to return to an initial configuration if flexed. For example, the flexible member may be constructed of a material, such as a vinyl polyester ("vinylester"), or polyester, and fiberglass composition which may be created by pulling fiberglass through a high content vinylester. The resilience and strength qualities of the vinylester fiberglass may be optimized to provide both the self-erection feature, and to enable a storage method to be employed whereby a structure may be stored in a carrier, such as a bag, pack, or rucksack.

In one embodiment of the present invention, the flexible member may contain a composite material made of fiberglass and polyurethane. For example, the composite material may comprise approximately 60% fiberglass and 40% polyurethane. In one embodiment, the composite material may comprise 71-72% fiberglass and 28-29% polyurethane. One embodiment of the present invention may comprise a flexible member having between approximately 50-65% fiberglass and between approximately 35-50% polyurethane. Other embodiments may comprise other ratios of fiberglass and polyurethane, or may comprise additional materials. In some embodiments of the present invention, a plurality of interconnected flexible members may be utilized to obtain the loops.

Figure 4:
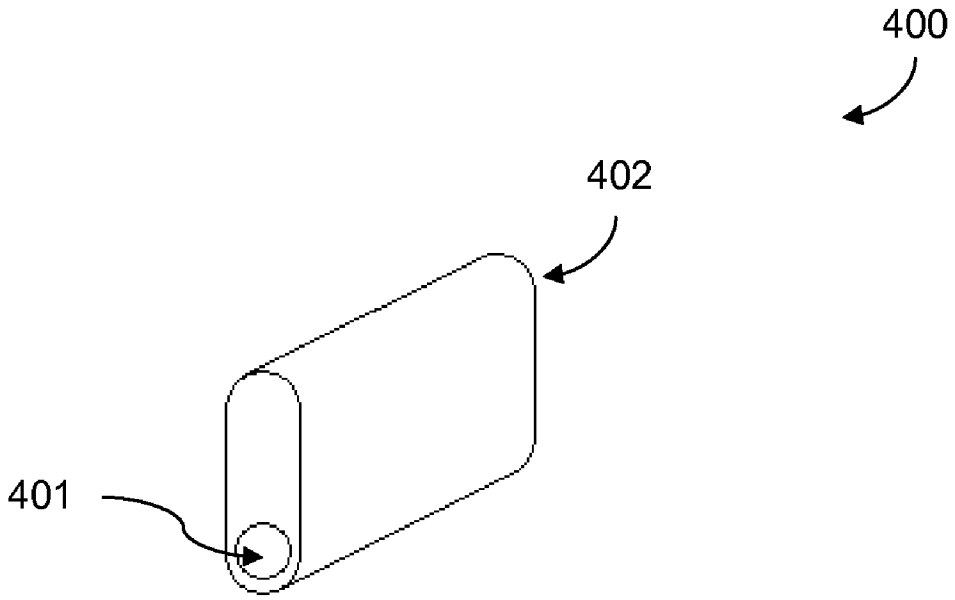
FIG. 4 shows a fitting according to one embodiment of the present invention.

In one embodiment of the present invention comprising a flexible member, the flexible member may comprise a length of flexible material having a first and second end. The first end and the second end may be coupled together to form a loop of flexible material. For example, in one embodiment of the present invention, the first and second ends may be coupled with an adhesive. In one embodiment of the present invention, the first and second ends may be coupled with a connector such as the one shown in FIG. 4. In one embodiment, the connector 400 may be configured to receive a first end of the flexible member in receptacle 401 and a second end of the flexible member in receptacle 402, such that the first end and the second end may be inserted into the connector in substantially the same plane at substantially the same orientation, but offset as may be seen in FIG. 4. The ends of the flexible member may be held in place within the connector by an adhesive or by frictional forces resulting from the ends of the flexible member tightly fitting within the receptacles. Such a connector may advantageously allow two ends of a flexible member to be joined to form a flexible loop.

In one embodiment of the present invention, the flexible member may comprise a plurality of lengths of flexible material, each having first and second ends. The plurality of lengths of flexible material may be coupled together to form a unitary flexible member. The two ends of the unitary flexible member may be coupled to form a single loop of flexible material.

The structure 100 includes a fabric shell 112 comprised of a lower portion 103 and an upper portion 104. In an embodiment, the lower portion 103 comprises a material, such as a Nylon taffeta, which has been configured to be water resistant. In an embodiment of the present invention, the fabric may be 190 count, 70 denier, and it meets CPA184 fire retardant standards, and it has a water repellent coating which exceeds 800 mm hydrostatic tests. In other embodiments, different materials may be used. For example in an embodiment in which additional strength may be advantageous, a rip stop Nylon may be used. In some embodiments, heat reflective material, or insulating material may be advantageous.

In the embodiment shown in FIG. 1, the material of the lower portion 103 forms the floor of the structure 100 as well as sleeves configured to receive the flexible member that forms loops 101 and 102, and extends about six inches upward from the base of the structure 100. Accordingly, the lower fabric portion 103 may prevent ground moisture, rainwater, or other liquids or contaminants, such as mud, dirt, foliage or other material, from entering the structure 100.

In the embodiment shown in FIG. 1, the upper fabric portion 104 comprises a mesh material. The mesh material may be configured to have sufficient permeability to air to allow circulation of fresh air into the structure, while providing protection from insects. The permeability of the mesh may be varied by changing the number of openings per unit of area (e.g. per square inch) of the mesh. In an embodiment, the material comprising the upper fabric portion 104 may be configured with an insect repellent to further provide protection from insects.

In the embodiment shown in FIG. 1, loop 102 forms the base of the structure 100. The springiness of loop 102 may hold the base open, flat, and in contact with the ground when the structure 100 is erect. Loop 101 has opposing ends which may be bent upward away from the base and may be received within sleeves of the shell to provide structure and support for the shell. In embodiments of the present invention, the structure 100 may be somewhat wider and higher at one end, herein referred to as the "head" end 105*a*, and it may be somewhat narrower and lower at the opposing "foot" end 105*b*.

An embodiment of the present invention as shown in FIG. 1 may be folded and stored in a bag, pack, or rucksack by twisting or folding the structure. The structure may be folded by first bringing the ends of the loops 101 and 102 together to form a single loop having head end 105*a* and foot end 105*b*. Next, the head end 105*a* may be twisted approximately 180 degrees relative to the foot end 105*b*, whereby a "figure eight" having two loops and an intersection may be formed. Then, the foot end 105*b* may be brought over the intersection, so as to bring the foot end 105*b* to the head end 105*a*, thereby causing the two loops to become concentric. The head and foot ends 105*a, b* may then be twisted approximately 180 degrees relative to the intersection, thereby forming a second, doubled "figure eight" having double loops and doubled intersection. Finally, the double loop, which includes the first intersection, may be brought over the doubled intersection, thereby causing the two sets of double loops to become concentric.

An embodiment of the present invention as shown in FIG. 1 maybe folded and stored in a bag, pack, or rucksack by twisting or folding the structure. The ends 105*a, b* may be brought together, and then turned on their side, leaving an upper half-loop having an "end" and a lower half-loop having an "end". The end of the upper half-loop may be brought around and under, forming three concentric rings. For simplicity, these three concentric rings may be regarded as a single ring. Following the steps outlined above, the three rings may be first twisted 180 degrees to form a pair of triple-concentric loops with an intersection. The triple concentric loops may be brought together over the intersection, thereby leaving six concentric loops. Due to the size and resilience of the material used to form the loops used in the present invention, the loop material may be further "squeezed" to make it even narrower (though somewhat longer) whereby it will readily fit within a bag, pack, or rucksack.

Figure 2:
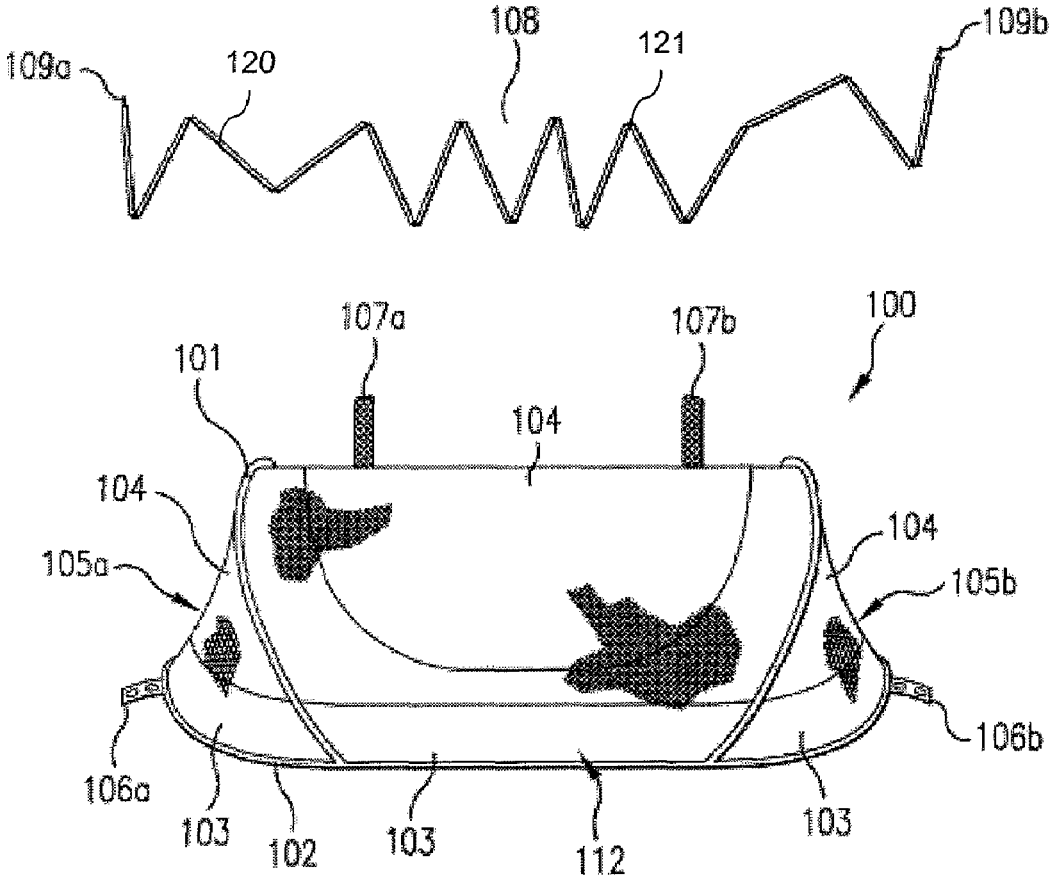
FIG. 2 is a diagrammatic view of a kit for erecting, securing, storing and transporting a structure in one embodiment of the present invention.
Figure 3:
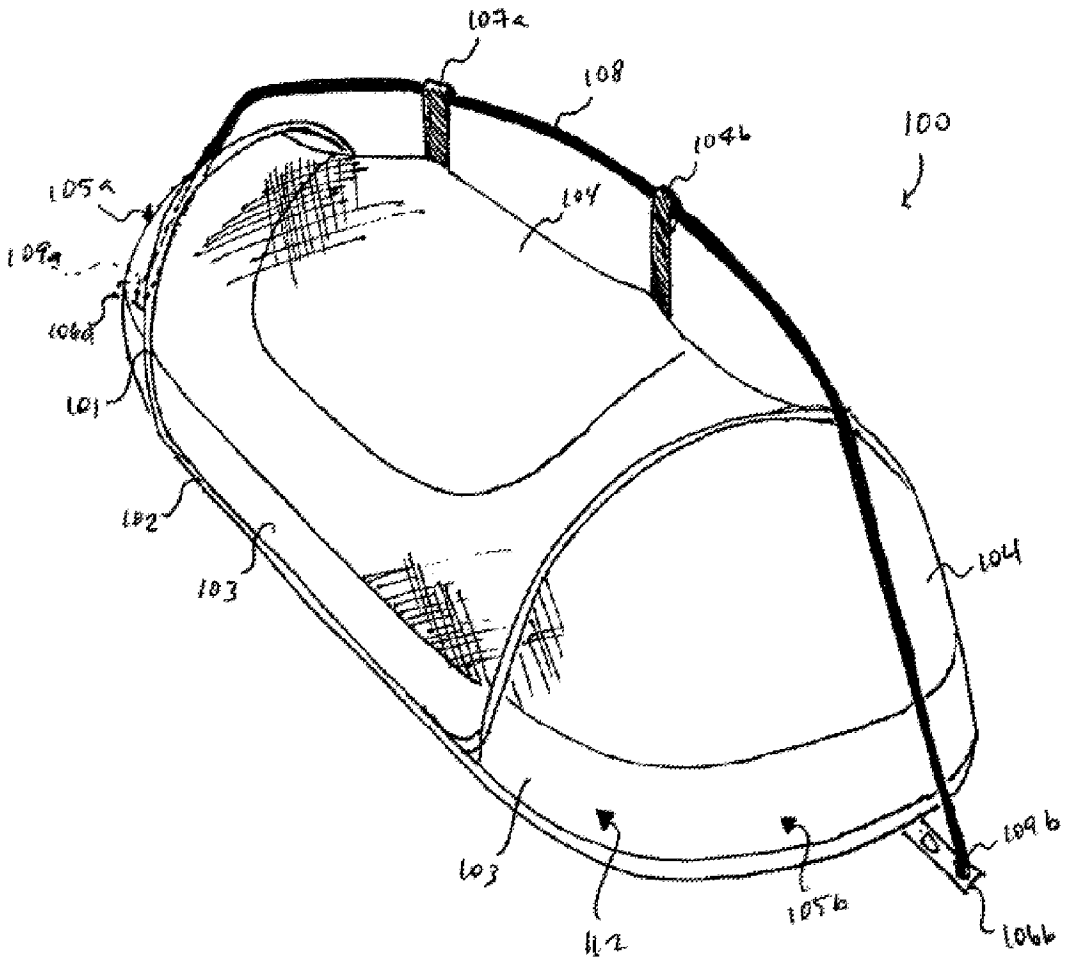
FIG. 3 is a diagrammatic view of a structure in one embodiment of the present invention.

The embodiment shown in FIGS. 2 and 3 further comprises a plurality of end portions 106*a, b,* a plurality of clips 107*a, b,* and fly pole 108. Fly pole 108 comprises a plurality of hollow members, including two hollow end members. In an embodiment, the fly pole 108 may be constructed of 7000 series aluminum alloy, which may provide advantageous memory and flexibility characteristics. In the embodiment shown in FIG. 3, all of the hollow members but two may be substantially straight. In other embodiments of the present invention, some or all of the hollow members may have other shapes including arcuate, angled or other shapes known to those of skill in the art. Two members in the embodiment shown in FIGS. 2 and 3 may be formed with an angled elbow, the purpose of which is described below.

The hollow members may each be configured with a receiving end and an insertion end. The receiving end of each hollow member may be configured to receive the insertion end of another hollow member. By coupling the receiving ends of a plurality of hollow members with the insertion ends of the plurality of hollow members, a unitary member may be formed of a length approximately equal to the lengths of the coupled hollow members. The hollow members may be further configured with an elastic member (not shown) which may pass through the hollow portions of the members. Each end of the elastic member may be coupled to the opposing end members. The length of the elastic member may be selected such that if all of the hollow members may be coupled together in series with the elastic member running therethrough, the force exerted by the elastic member held in tension may cause the plurality of hollow members to remain coupled together to form a fly pole 108.

In one embodiment, the receiving end and the coupling end of hollow members of the fly pole 108 may be machined to tolerances such that two coupled hollow members could easily and tightly, but in such a way as make decoupling of the members more difficult if there is a flexing force applied to the coupling. Such a configuration may prevent the unintentional decoupling of the fly rod 108.

In the embodiment shown in FIGS. 2 and 3, the shape of the assembled fly pole 108 may be configured to substantially conform to the shape of the erected structure. The angled portions of the fly pole may be configured to approximately conform the fly pole to the shape of the erected structure.

In an embodiment of the present invention, the hollow members of the fly pole 108 may have a length less than the diameter of a self-erecting structure in a folded or stored configuration.

In the embodiment shown in FIGS. 2 and 3, the fly pole 108 may be coupled to the structure to provide additional structural support. A first end of the fly pole may be inserted into a grommet in end portion 106*a*. A fitting 109*a* on the first end of the fly pole may be configured to engage the grommet in end portion 106*a*. The second end of the fly pole may be inserted into a grommet in end portion 106*b*. A fitting 109*b* on the second end of the fly pole 108 may be configured to engage the grommet in end portion 106*b*. The fittings 109*a, b* and grommets in end portions 106*a, b* may be configured such that when the fly pole 108 may be assembled and the fittings 109*a, b* may be inserted in the grommets, the fly pole may be flexed, and the fittings 109*a, b* engage the grommets, such that the fittings 109*a, b* may not disengage from the grommets unless intentionally removed.

Figure 5:
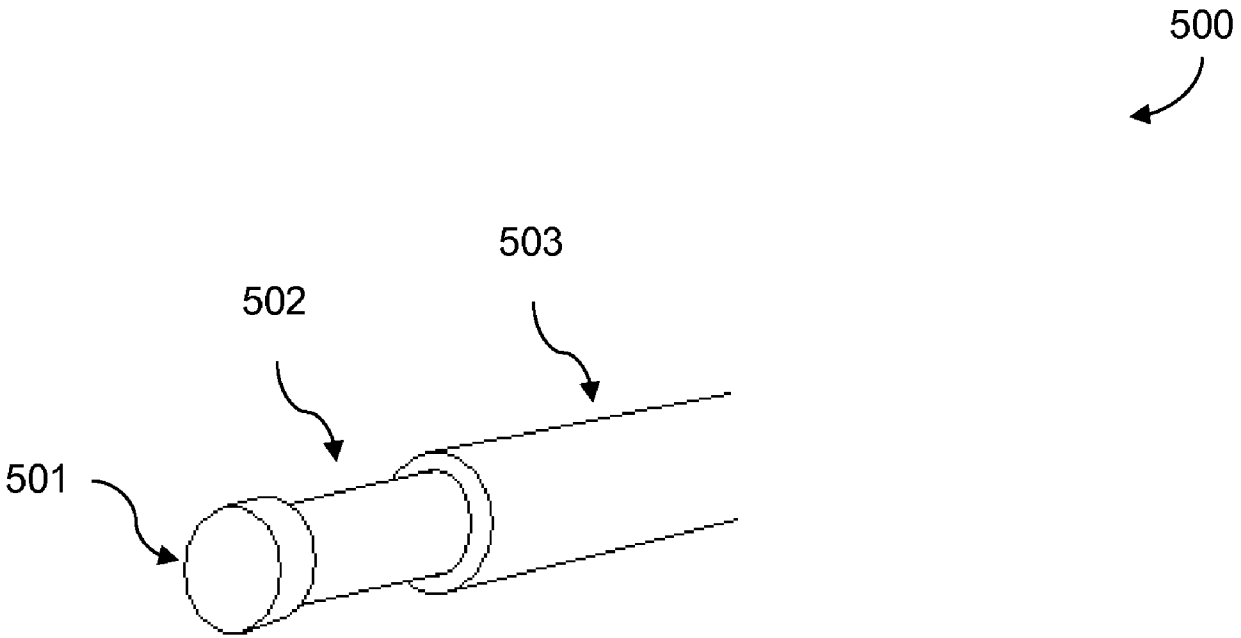
FIG. 5 shows a fitting according to one embodiment of the present invention.

For example, FIG. 5 shows a fitting 500 according to one embodiment of the present invention. The fitting comprises an end portion 501 having a substantially circular cross-section having a first diameter. The fitting further comprises a neck portion 502 having a substantially circular cross-section and having a second diameter, where the second diameter is smaller than the first diameter. The fitting is coupled to the end member 503 of a fly pole according to one embodiment of the present invention. End portion 501 is configured to engage with a grommet 106*b* such as can be seen in FIG. 3.

In the embodiment shown in FIG. 3, grommet 106*b* comprises an annular shape having a central hole through which the fitting may be inserted. The central hole of the grommet 106*b* has a diameter greater than the first diameter of the end portion 601 of the fitting, however, the first diameter of the end portion 601 is machined to a tolerance such that the end portion must be inserted into the grommet 106*b* in a direction substantially perpendicular to the plane in which the grommet 106*b* is located. If fitting 600 is inserted at an angle that is not substantially perpendicular, the fitting may not pass through the central hole of the grommet. Such a configuration may provide the advantage that, once fitting 600 is inserted into grommet 106*b*, fitting 600 may be unlikely to accidentally disengage with grommet 106*b*, as the end portion must be removed in a direction substantially perpendicular to the plane in which the grommet 106*b* is located. This may provide an advantage to a single person attempting to erect the structure as a fitting on the first end of a fly pole inserted into a grommet may not need to be held in place while the person attempts to insert the fitting on the second end of the fly pole into a grommet in a different location. It should be noted that while the embodiment described above relates to a grommet coupled to a self erecting structure, similar grommets may be coupled to a rain fly, which may allow a person to erect a structure comprising only the fly pole and the rain fly.

Figure 6:
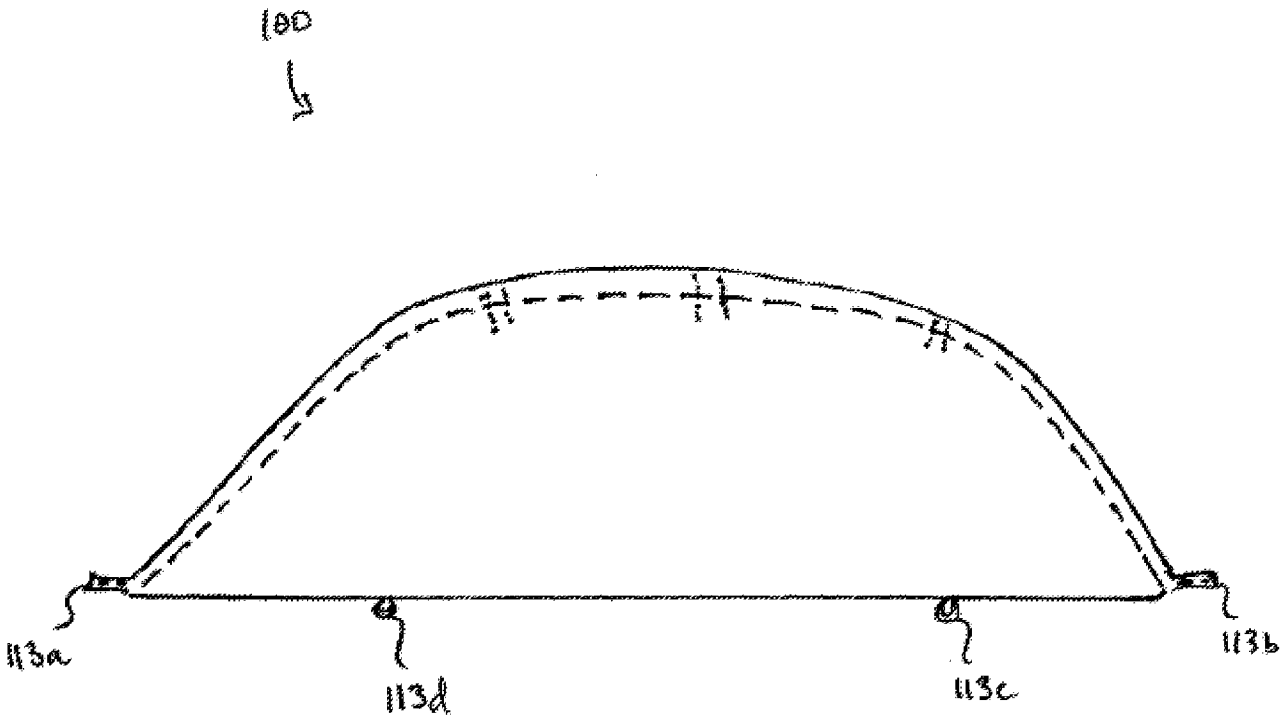
FIGS. 6 and 7 are diagrammatic views of a structure in one embodiment of the present invention.
Figure 7:
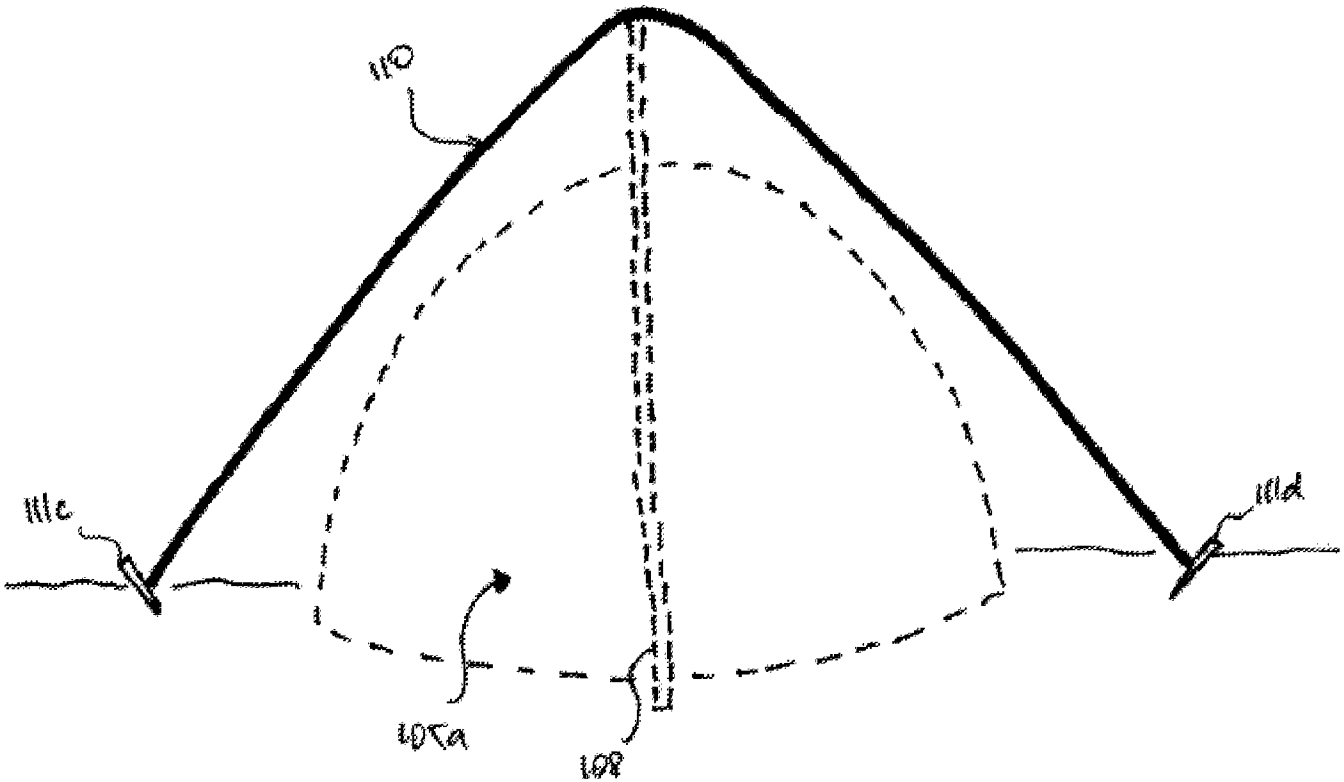

FIGS. 6 and 7 show different views of an embodiment of the present invention. The embodiment of the present invention shown in FIGS. 6 and 7 comprises the structure shown in FIGS. 1-3, and further comprises a fly 110, stakes 111*a-d*, and loops 113*a-g*. In the embodiment shown in FIGS. 4 and 5, the portable structure may be assembled as described above. Once the structure 100 is assembled, fly 110 may be positioned over the fly pole 108, and extended to the surface on which the structure 100 rests. Fly 110 comprises loops 113*a-g*, which may be configured to receive stakes, including stakes 111*a-d*, or fly pole 108. Loops 113*a-g* may also be configured to releasably engage with portions of a cot or bed, or may be configured to engage with portions of other embodiments of the present invention, such as loops on another fly. In the embodiment shown in FIGS. 6 and 7, stakes 111*a-d*, as well as additional stakes (not shown) may be inserted into loops 113*a-g*, and the stakes 111*a-d* may further be driven into the ground to provide an anchor for the fly 110. Further, stakes 111*a, b* may be additionally received by end portions 106*a, b* such that stakes 111*a, b* provide an anchor for both the fly 110 and the structure 100.

In one embodiment of the present invention, the fly 110 may be a poncho, with or without a hood, or other waterproof garment, such as a raincoat, positioned over the fly. In one embodiment of the present invention, the fly 110 may be constructed from a waterproof material, or may be otherwise configured as waterproof. The fly 110 may be advantageously employed to reduce the effects of wind, rain, dust, dirt, insects or other environmental conditions on the structure and its occupant. In an embodiment of the present invention, the fly 110 may be configured with a flap that may comprise a zipper, buttons, snaps, clips or other fastener to allow selective access of persons or environmental conditions to and from the structure through the flap.

Figure 8:
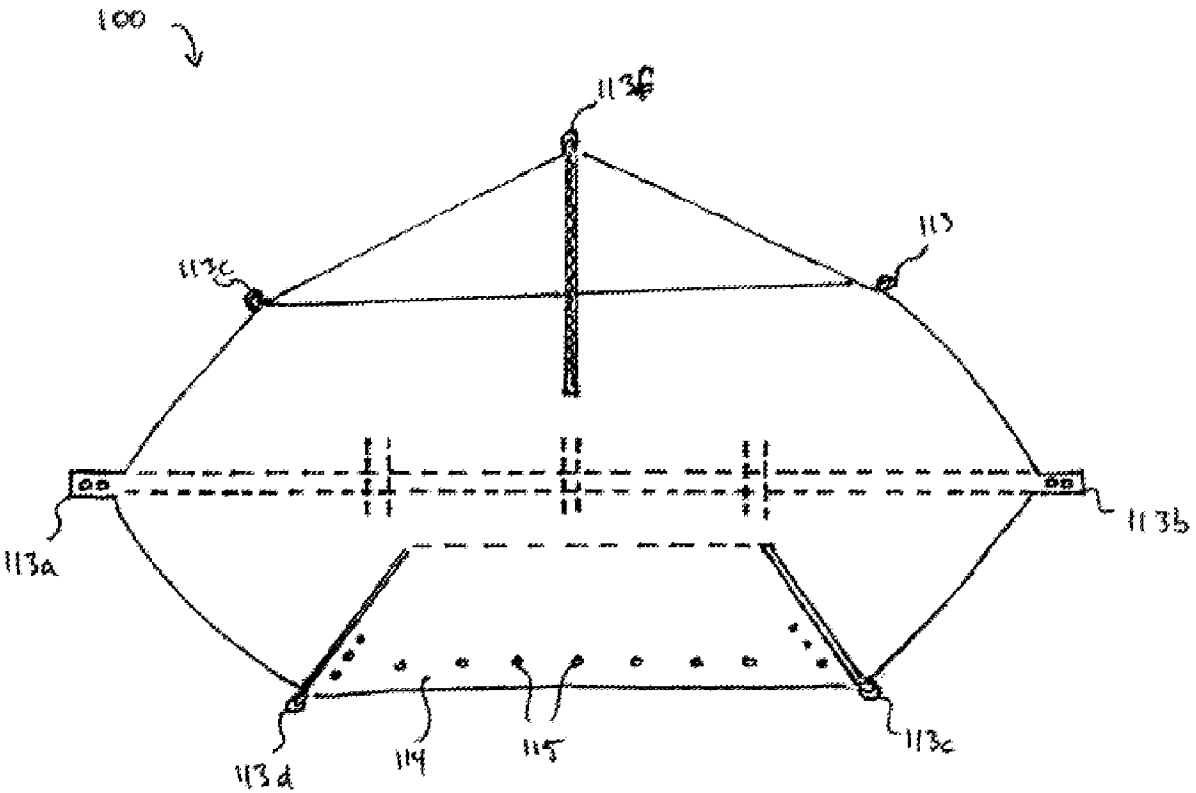
FIGS. 8 and 9 are diagrammatic views of a structure according to one embodiment of the present invention.
Figure 9:
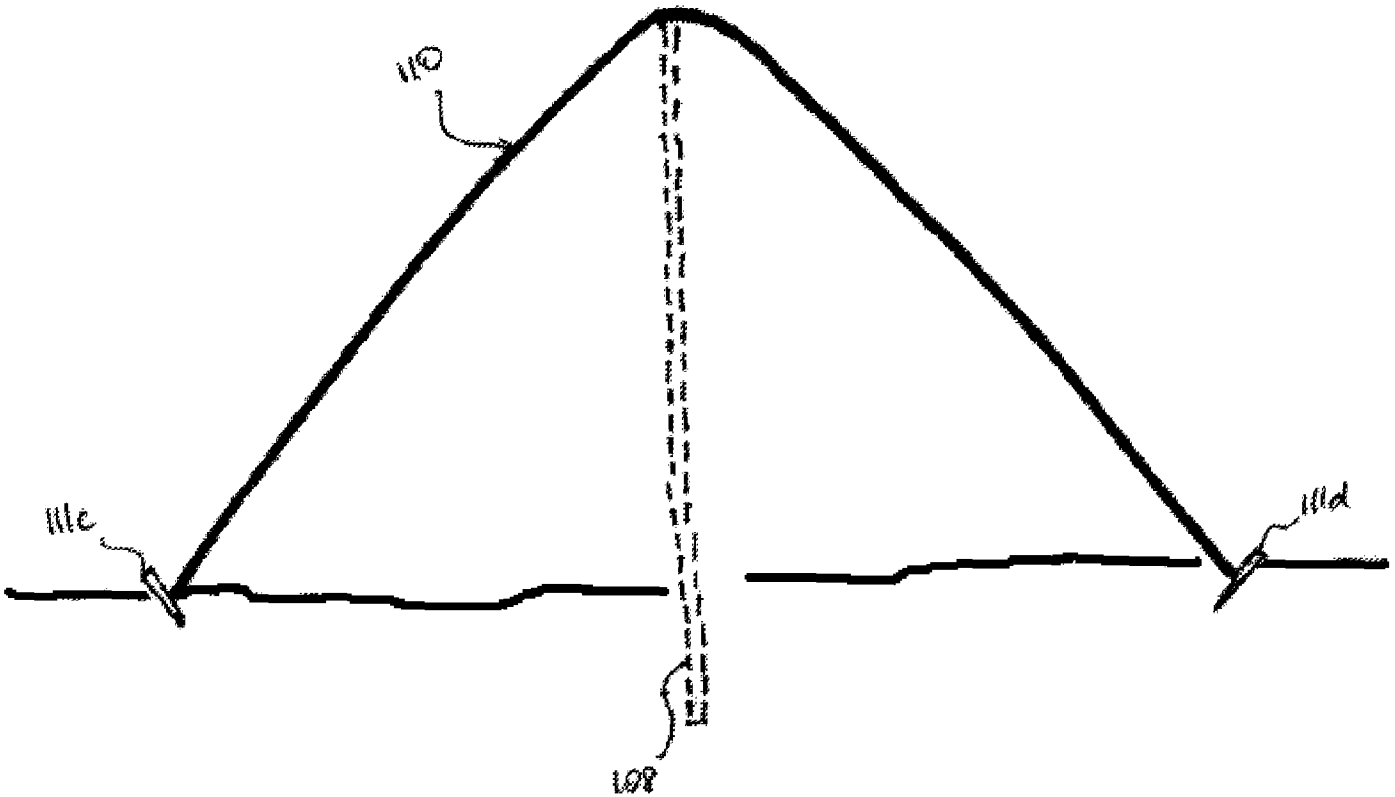

FIGS. 8 and 9 show a diagrammatic view of an embodiment of the present invention comprising a fly pole 108 and a fly 110, but without a self-erecting or other structure, such as in the embodiment shown in FIGS. 6 and 7, underneath, though such a structure could be suitably employed to provide additional protection from environmental conditions. The fly pole 108 can be constructed as described above by coupling a plurality of hollow members in series with two end members comprising fittings. The fittings may be inserted into grommets incorporated into the fly 110. The fly 110 may then be positioned over the fly pole and releasably engaged to the fly pole using fasteners, such as Velcro straps, hooks, or loops. Loops 113*a-g* may then be used to stretch the fly to provide for an interior space beneath the fly 110. Once the fly 110 has been stretched to create an interior space, stakes may be driven through loops 113*a-g* to anchor the fly 110 to the ground, or the fly 110 may be attached to local vegetation. By anchoring one or more loops, the structure may remain substantially upright and the securing force supplied by the stake or vegetation may aid in keeping the single fly pole from falling to one side or the other. Using such an embodiment, it may be possible to create a lightweight shelter using the fly pole 108 and the fly 110 without an interior structure, such as a portable structure. Further, the fly 110 may be configured with a releasably engaged flap that may be employed as an entryway into the structure. For example, the fly may be configured with a zipper, which may be opened or closed to allow access to the interior of the structure.

Figure 10:
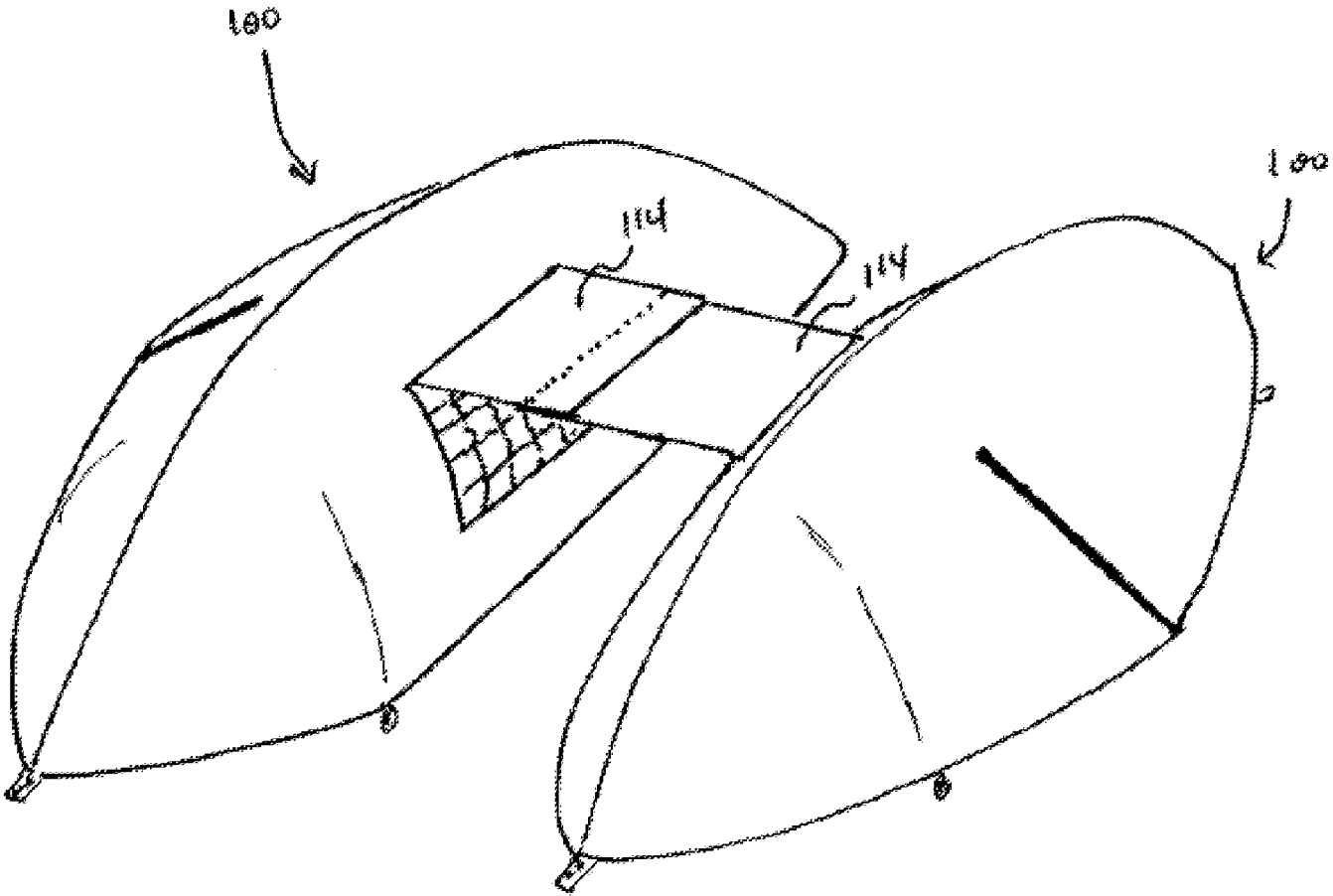
FIG. 10 is a diagrammatic view of two structures according to one embodiment of the present invention.

FIG. 10 shows an embodiment of the present invention. In an embodiment of the present invention, the fly 110 described above may be configured with a flap 114 that may be opened to allow access to the structure formed by the fly pole and rain fly. In one embodiment, two such structures may be erected in close proximity and a flap on a first structure may be coupled to a flap on a nearby fly 110 as shown in FIG. 10. If flaps 114 on flies 110 of adjacent structures may be both opened, they may be secured to each other using fasteners 115 incorporated within each flap 114. In such a configuration, occupants of the adjacent structures may be able to engage in communication through the open flaps.

Embodiments of the present invention may provide advantages such as waterproof protection from rain and snow. Embodiments may further provide ventilation and reduction or elimination of visible light both within the structure, or from outside the structure, as well as camouflage protection. Embodiments of the present invention may be advantageously employed as a field expedient litter for transporting wounded soldiers, or as a cover for equipment.

Figure 11:
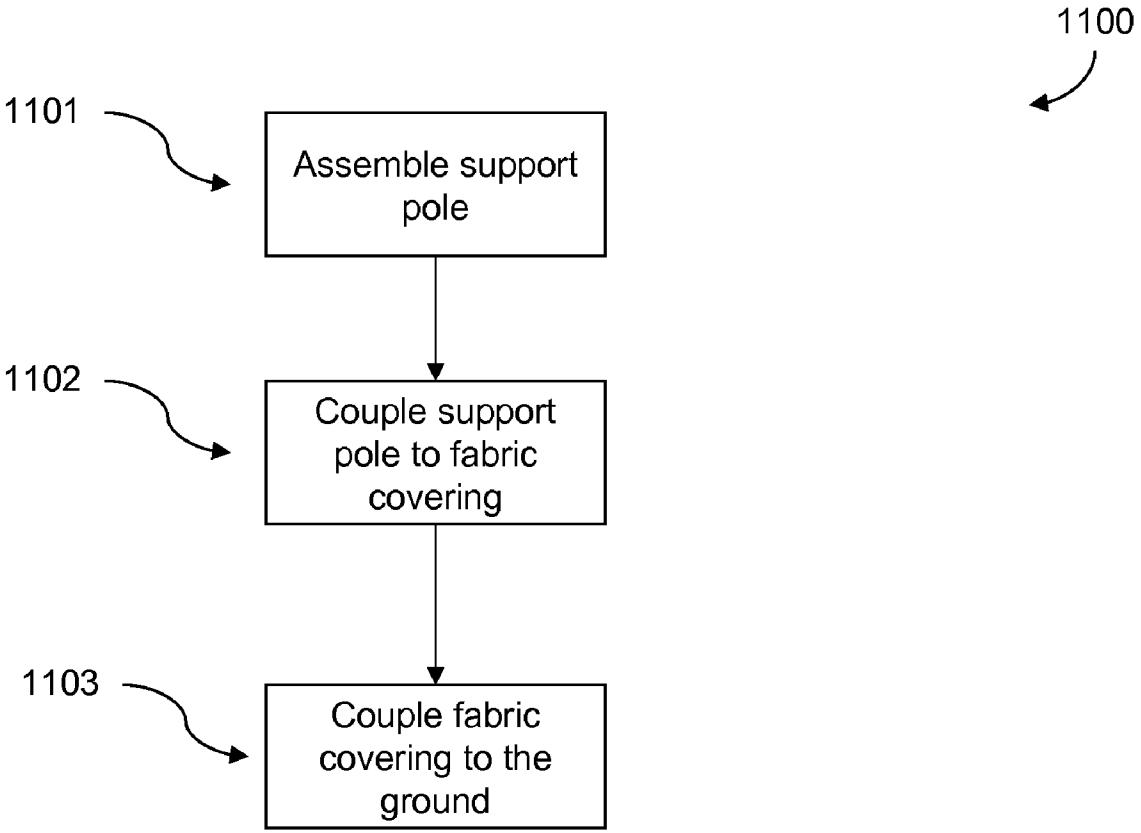
FIG. 11 is a flowchart for assembling a structure according to one embodiment of the present invention.

Embodiments of the present invention also comprise methods for assembling a structure. FIG. 11 shows a flowchart describing one method 1100 for assembling a structure according to one embodiment of the present invention. The method begins with block 1101 by assembling a support pole. In one embodiment of the present invention, the support pole comprises a fly pole as described above, having a plurality of hollow members and two end members, and further having an elastic cord extending through each of the hollow members and coupled to each end member.

The method 1100 continues in block 1102 with the step of coupling the assembled support pole to the fabric covering such that the fabric covering is supported by the support pole and provides a roof and at least one wall for the structure. For example, in one embodiment, the fabric covering may be coupled to the support pole by first coupling fittings on the support pole with grommets coupled to the fabric opening. Fittings, such as those described in relation to FIG. 5, may be advantageously employed with corresponding grommets to provide a secure coupling between the ends of the support pole and the fabric covering. Additionally, or instead, one or more clips coupled to the underside of the fabric covering may then be coupled to the support pole. The support pole may then be rested on the supporting surface, such as the ground, such that the two end members of the support pole provide the base of the structure.

The final step 1103 comprises coupling the fabric covering to the ground. For example, the fabric covering may comprise one or more loops through which a stake may be inserted. The stake may then be driven into the ground, such that stakes on opposing sides of the structure help provide stability to the structure.

The foregoing description of the embodiments, including preferred embodiments, of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the invention.

That which is claimed is:

1. A structure, comprising:

a single support pole comprising:

first and second hollow end members, each hollow end member comprising a first end having a fitting configured to engage with a fastener, and a second end configured to engage with an interior member, a plurality of hollow interior members each having two ends, and an elastic member having first and second ends, the first end of the elastic member is coupled to the interior of the first end of the first hollow end member, the second end of the elastic member is coupled to the first end of the second hollow end member, and wherein the elastic member extends through the interior of each of the plurality of hollow interior members, the elastic member configured to provide a force to hold the interior members and ends together to form the single support pole;

a fabric covering having at least two fasteners;

a first flexible member;

a fabric shell comprising a floor portion and an upper portion, at least two fasteners formed on opposite sides of the floor portion, and further comprising a sleeve configured to receive the first flexible member, the first end and the second end of the single support pole coupled to the at least two fasteners of the floor portion to hold the single support pole in an erected position, the fabric shell configured to couple to the single support pole and be enclosed by the fabric covering, and wherein the first flexible member is configured to exert a force on the fabric shell to provide structural support for the structure, and the first flexible member is configured to cause the structure to substantially self-erect, and the fabric covering is configured to be coupled to the support pole such that the fabric shell forms at least one wall and a roof for the structure, and wherein the fabric shell is configured to be secured to the ground.

2. The structure of claim 1, wherein the fittings of each hollow end members comprise machined fittings configured to engage with the at least two fasteners of the fabric shell, wherein each machined fining is configured to engage with one of the fasteners only if the machined fitting is inserted into the fastener substantially perpendicularly to the plane in which the fastener lies.

3. The structure of claim 2, wherein each fastener comprises a grommet.

4. The structure of claim 1, wherein the fabric covering or the fabric shell further comprises a clip for engaging with the support pole.

5. The structure of claim 1, wherein the fabric covering or the fabric shell comprises one of nylon or polyester.

6. The structure of claim 1, where in the fabric covering or the fabric shell comprises a waterproof covering.

7. The structure of claim 1, wherein the fabric covering comprises an insect repellant.

8. The structure of claim 1, wherein the fabric covering or the fabric shell comprises a zipper to allow entry into the shell.

* * * * *

UNITED STATES PATENT AND TRADEMARK OFFICE

CERTIFICATE OF CORRECTION

PATENT NO. : 7,559,335 B2
APPLICATION NO. : 11/740043
DATED : July 14, 2009
INVENTOR(S) : George G. Smith It is certified that error appears in the above-identified patent and that said Letters Patent is hereby corrected as shown below:

Column 10, Claim 2, line 1, please delete "fining", please insert -- fitting --.

Signed and Sealed this

Twentieth Day of October, 2009

David J. Kappos

David J. Kappos
*Director of the United States Patent and Trademark Office*